US005670304A

United States Patent [19]

Juers

[11] Patent Number: 5,670,304

[45] Date of Patent: Sep. 23, 1997

[54] RECYCLING SPENT HYDROQUINONE DEVELOPER AND A RECYCLED HYDROQUINONE DEVELOPER

[75] Inventor: Daniel Frederick Juers, Fairport, N.Y.

[73] Assignee: E. I. Du Pont de Nemours and Company, Wilmington, Del.

[21] Appl. No.: 704,045

[22] Filed: Aug. 28, 1996

Related U.S. Application Data

[63] Continuation of Ser. No. 489,419, Jun. 12, 1995.

[51] Int. Cl.[6] ..... G03C 5/395

[52] U.S. Cl. ..... 430/399; 430/398

[58] Field of Search ..... 430/398, 399

[56] References Cited

U.S. PATENT DOCUMENTS

| | | | |
|---|---|---|---|
| 3,828,172 | 8/1974 | Schickler | 430/30 |
| 3,970,957 | 7/1976 | Passonage | 430/399 |
| 4,025,344 | 5/1977 | Allen et al. | 430/399 |
| 4,081,280 | 3/1978 | Corluy et al. | 430/399 |
| 4,228,234 | 10/1980 | Okutsu et al. | 430/399 |
| 4,245,034 | 1/1981 | Libicky et al. | 430/399 |
| 4,310,622 | 1/1982 | Onda et al. | 430/445 |
| 4,311,574 | 1/1982 | Ishikawa | 430/399 |
| 4,348,475 | 9/1982 | Wernicke et al. | 430/399 |
| 4,464,036 | 8/1984 | Taniguchi et al. | 430/30 |
| 4,527,878 | 7/1985 | Taniguchi et al. | 430/30 |
| 4,719,173 | 1/1988 | Hahm | 430/399 |
| 4,786,584 | 11/1988 | Endo | 430/399 |
| 4,977,067 | 12/1990 | Yoshikawa et al. | 430/399 |
| 4,988,448 | 1/1991 | Woog | 430/399 |
| 5,057,858 | 10/1991 | Woog | 354/324 |
| 5,160,417 | 11/1992 | Neale | 204/130 |
| 5,212,098 | 5/1993 | Hoffmann et al. | 430/399 |
| 5,344,741 | 9/1994 | Iwata et al. | 430/265 |
| 5,466,563 | 11/1995 | Ishikawa et al. | 430/30 |
| 5,565,308 | 10/1996 | Carli et al. | 430/400 |

FOREIGN PATENT DOCUMENTS

| | | | |
|---|---|---|---|
| 765994 | 9/1971 | Belgium | 430/399 |
| 0114402 | 8/1984 | European Pat. Off. | 430/30 |
| 0 314 124 A3 | 5/1989 | European Pat. Off. | G03C 5/395 |
| 0382200 A2 | 8/1990 | European Pat. Off. | G03C 5/305 |
| 0585792 A2 | 3/1994 | European Pat. Off. . | |
| 53-13416 | 2/1978 | Japan | 430/399 |
| 54-37731 | 3/1979 | Japan | 430/30 |
| 56-92537 | 7/1981 | Japan | 430/30 |
| 61-259247 | 11/1986 | Japan | 430/30 |
| 61-259248 | 11/1986 | Japan | 430/30 |
| 1439502 | 6/1976 | United Kingdom | 430/30 |

OTHER PUBLICATIONS

Grant Haist: "Modern Photographic Processing, vol. 1", 1979, John Wiley and Sons, NY, US XP002016139, pp. 223–225, Maintenance of Developer Activity, p. 221.

British Kinematography Sound and Television Society Journal, vol. 66, No. 7, Jul. 1984, London, GB, pp. 320–324, XP002016137, Jeno Paizs: "How to Minimise Developer Comsumption", p. 322, Left–Hand col., line 5–26.

Journal of Imaging Technology for Imaging Science and Technology, vol. 10, No. 6, Dec. 1984, Springfield, US pp. 212–216, XP002016138, T. N. Hendrickson et al: "The Critical Role of Sulfite in the Reuse of Photographic Solutions", p. 213, Sulfite in Solution Recycle.

Database WPI, Section PQ, Week 8802, Derwent Publications Ltd., London, GB; Class P83, AN 88–009460, XP002016140 & JP–A–62 270 953 (Fuji Photo Film KK), 25 Nov. 1987, Abstract.

Lazaridis, Christina N., "Hydroquinone Oxidation in Lithographic Developers," Photographic Science and Engineering, 20, No. 1, 20–23, Jan./Feb. 1976.

Drew Products' Flyer, "RDF, A New Generation of Technology", 826 Kinderkamack Road, River Edge, NJ 07661.

Process Resource Management Pamphlet, "DEV–PAC", USI, 7707, 12022, 9602, 9203, Aug. 1991.

*Primary Examiner*—Hoa Van Le

[57] ABSTRACT

A process for recycling a spent hydroquinone developer for black-and-white photographic processing which comprises the steps of determining the volume of developer, optionally filtering the developer, and reconstituting the developer, whereby the spent developer is brought back to substantially the same composition and/or level of performance as fresh developer wherein the recycled developer can be used to process black-and-white photographic materials without adverse effects.

10 Claims, No Drawings

RECYCLING SPENT HYDROQUINONE DEVELOPER AND A RECYCLED HYDROQUINONE DEVELOPER

This is a continuation of application Ser. No. 08/489,419, filed Jun. 12, 1995.

BACKGROUND OF THE INVENTION

1. Field of the Invention

The invention relates to a process of recycling a spent photographic developer wherein the spent developer is collected and reconstituted and can be re-used without detrimental effect on films processed therein.

Photographic developers are well-known in the art. The development of exposed silver halide photographic elements comprises a multiple step process of development, fixing, washing and optionally a stopping step. The development step is conventionally undertaken with an aqueous alkaline developer composition (or developer) which includes a developing agent either singly or with one or more additional developing agents. A comprehensive list of developing agents is provided in C. E. K. Mees, *The Theory of the Photographic Process* Chapters 14–15 (rev. ed. 1959). The most commonly used developing agent, particularly for processing black-and-white photographic silver halide elements is hydroquinone. The hydroquinone or other suitable developing agent serves as a strong silver reducing agent to reduce silver halide grains containing a latent image to yield a developed photographic image.

Hydroquinone-based developers have been successfully employed for many years, but in recent years, various guidelines and regulations have been imposed that impact on the use of these conventional developers. This is due to the toxicity and environmental hazards associated with the hydroquinone and other components comprising the developer, as well as the generally alkaline nature of the developer.

In view of the current environmental concerns surrounding the discharge of spent photographic developers into the environment and the likelihood of increased environmental regulations, it is highly desirable to eliminate or reduce the introduction of the spent developer effluent into the environment by recycling the used developer. Apart from the obvious environmental benefits of recycling, there are also financial advantages to recycling the spent developer due to a reduction in the amount of raw materials needed and in the cost of compliance with environmental regulations.

A major obstacle to recycling, however, is being able to reconstitute the developer such that the performance of photographic materials in the recycled developer is equivalent or substantially equivalent to the performance of the photographic materials in fresh developer. Conventional hydroquinone-based developers typically have been poor recycling prospects because certain oxidation products of hydroquinone (formed during development of photographic materials) produce large, dark (almost black in color) polymeric compounds which are difficult to quantitatively analyze and separate from the developer. The presence of these undesirable oxidation products in developers contributes to sludge formation and staining of photographic elements processed therein.

The aforementioned environmental and cost issues have been addressed by recycling reconstituted used developers containing ascorbic acid and derivatives thereof as described in U.S. patent application Ser. No. 08/170,595, filed Dec. 21, 1993, which is a continuation-in-part of U.S. patent application Ser. No. 07/941,343, filed Sep. 4, 1993.

However, hydroquinone is a widely used developing agent and, further, there are photographic applications in which ascorbic acid developers are not typically as suitable as hydroquinone developers would be, for example, in the development of hydrazine-containing films to achieve satisfactory speed, contrast and image quality. As such, there also is a great need for recycling spent hydroquinone developers.

SUMMARY OF THE INVENTION

In accordance with this invention there is provided a process for recycling a spent black-and-white photographic developer comprising the steps of:

a) determining a volume, $V_i$, of the spent developer resulting from use of a fresh developer wherein the fresh developer comprises
   (1) a developing agent selected from a group consisting of hydroxybenzene compounds, derivatives of hydroxybenzene compounds, and mixtures thereof, and
   (2) a compound which provides a sulfite concentration of 0.65 to 1.5 molar;

b) analyzing the spent developer to determine the pH and the concentration of critical components, which are primary developing agents, secondary developing agents, bromides, antifoggants, sulfites, and alkanol amines;

c) reconstituting the spent developer for reuse, based on results of a) and b), comprising:
   (1)determining a final volume, $V_f$, of reconstituted developer based on the relationship:

$$V_{min}=(V_i \times B_i)/B_a$$

where $V_{min}$=minimum volume of reconstituted developer and $V_f$ is greater than or equal to $V_{min}$ $B_a$=aim concentration of bromide in the reconstituted developer $B_i$=analyzed concentration of bromide in the spent developer, (2)diluting the spent developer with water and/or a special developer such that: a volume of water, $V_w$, is greater than or equal to zero;
   a volume of special developer, $V_s$, is greater than or equal to zero; and $$V_w+V_s=V_f-V_i$$

(3)adding amounts of the critical components in sufficient quantity to achieve aim concentrations as determined from the equation, $$\text{Amount of critical component to add}=(V_f \times CC_a)-(V_i \times CC_i)-(V_s \times CC_s)$$

where $CC_a$=aim concentration of critical component $CC_i$=analyzed concentration of critical component in spent developer $CC_s$=concentration of critical component in special developer with the proviso that the total amount of critical component added is greater than or equal to zero, (4)adding amounts of non-critical components as determined from the equation, $$\text{Amount of non-critical component to add}=\{(V_f-V_i) \times NC_a\}-(V_s \times NC_s)$$

wherein $NC_a$=aim concentration of non-critical component $NC_s$=concentration of non-critical component in special developer with the proviso that the total amount of non-critical component added is greater than or equal to zero, and wherein steps c)(1), c)(2), c)(3) and c)(4) can be performed in any order.

In another aspect, the present invention comprises a black and white photographic developer capable of being recycled according to the above process. In yet another aspect, the present invention comprises a recycled, black-and-white photographic developer made according to the above process.

DETAILED DESCRIPTION OF THE PREFERRED EMBODIMENT(S)

This invention is a process for recycling spent hydroquinone-type developers wherein the spent developer is analyzed and reconstituted so that the recycled developer will perform substantially equal to fresh developer. The invention is also a developer that can be recycled according to the process and the recycled developer resulting from the process.

DEVELOPERS

The benefits of the present process are achieved for developers containing hydroquinone-type developing agents. Here the term developer is meant in a general sense to encompass certain categories of developers that will be specifically referred to later in this application. For example, the term "fresh developer" denotes a developer which is newly mixed, and/or which has not been used to develop any film, and/or which has not been held at elevated development temperatures, i.e., about 95° F. to about 110° F., for any extended period of time, that is, up to about 12 hours. Fresh developer includes components with each having an original starting concentration. The term "spent developer" as used herein, means a developer which has been used to process photographic film or which otherwise has lost some of its development activity as compared to fresh or virgin developer. A "working developer" may also be referred to in this application. A working developer is one that is in a processor at any given time and being used to develop photographic material in the processor. It is understood that at some period in time during its use in processing a sufficient quantity of film that fresh developer will become spent developer. To be a successful candidate for recycling, the developer must be one which avoids the combination of disadvantages that previously has been presented by the presence of hydroquinone-type developing agents.

The developer comprises hydroxybenzene-based primary developing agents which include hydroquinone and other such compounds suitable for use as developing agents. It should be noted that certain oxidation products of hydroquinone, such as hydroquinone monosulfonic acid and hydroquinone disulfonic acid are acceptable (unlike those noted above) because even though they are oxidation products that form during processing and add to the complexity of the developer, they are also developing agents. These compounds are considered critical components for the purpose of this invention. The developer also comprises secondary developing agents, antifoggants, bromides, alkanol amines and antioxidants which are considered critical components for the purpose of this invention. The pH of the developer is also considered critical. A critical component or characteristic is one whose concentration is critical to developer performance and/or whose concentration changes significantly either in storage or as a result of the physical or chemical action of the developer on the film during processing. Non-critical components are those having some effect, but are usable over a broad range of concentrations and are not appreciably affected by storage or reaction with the film.

CRITICAL COMPONENTS

The primary developing agents include, but are not limited to, hydroquinone, pyrocatechol, methyl hydroquinone, and other hydroxybenzene compounds suitable for use as developing agents.

Secondary developing agents include, but are not limited to, pyrazolidone, N-Methyl-p-aminophenol sulfate (metol), and derivatives thereof, with metol being particularly preferred.

Antifoggants are present to prevent formation of minimum density in areas where development is not intended. Antifoggant agents include, but are not limited to, benzotriazole, phenylmercaptotetrazole, benzimidazole, indazole, nitroindazole, and derivatives thereof, used alone or as mixtures.

Soluble bromides, particularly alkali metal bromides are also used as antifogging agents. Potassium bromide and sodium bromide are the preferred.

Antioxidants, such as sulfites, are typically present in developers as preservatives and/or accelerating compounds. It has been known for some time that sulfite inhibits oxidation of hydroquinone. See Lazaridis, *Hydroquinone Oxidation in Lithographic Developers*, 20:1 Photographic Science and Engineering 2 (January/February 1976). It has been found that a significantly higher level of sulfite than typically used in hydroquinone developers limits the rate of formation of the dark-colored oxidation products of hydroquinone. The formation of these dark-colored oxidation products has prevented hydroquinone from being a good candidate for recycling heretofore. A relationship between molarity of sulfite and oxidation of hydroquinone exists and it has been found that a three-fold to four-fold increase in the sulfite content above that typically observed in hydroquinone developers can result in a ten-fold increase in stability of the hydroquinone, with stability meaning resistance to oxidation. Examples of useful compounds include, but are not limited to, alkali metal sulfites, bisulfites, metabisulfites and carbonyl-bisulfites adducts. A preferred antioxidant is sodium bisulfite.

Alkanol amines which act as development enhancers are critical components in this invention. A particularly preferred alkanol amine is 3-diethylamino-1,2-propanediol (DEAPD). The alkanol amines can include primary, secondary, or tertiary amines.

An anti-sludge agent is added to the developer to prevent undesirable deposits on rollers of a processor or on the film. A preferred anti-sludge agent is 2-mercaptobenzothiazole (2-MBT).

The pH of the developer is a critical characteristic and is adjusted in the range of about 9.5 to 12.5, preferably 11.1 to 11.6. The pH is adjusted by adding alkali metal hydroxides or sodium hydrogen sulfite. The sodium hydrogen sulfite is particularly suitable for adjusting pH in this invention considering that it is also used as an antioxidant as noted above. There are many other substances that can be used to adjust pH known to one of ordinary skill in the art.

Critical components were defined above, however it should be noted that depending on the desired commercial application, that some substances not listed herein as critical could be deemed as such for the particular application. For example, the claimed invention does not incorporate a development accelerator which is often included in a developer to increase developer activity. However, in a different commercial application, such a substance could be deemed as a critical component and, as such, would be considered as falling within the scope of this invention. Further, non-critical components in a particular application could be deemed critical in some other application, and alternatively critical components in a particular application could be deemed non-critical in some other application. This provides flexibility for situations where a particular photographic application or a particular performance of the developer is desired.

A suitable hydroquinone developer whether designated as fresh or working developer may comprise the following critical components:

| Component | Usable Range (moles/liter) | Preferred Range (moles/liter) |
|---|---|---|
| Sulfite Ion | 0.65 to 1.50 | 0.70 to 1.00 |
| Bromide Ion | 0.01 to 0.15 | 0.05 to 0.10 |
| Pri. Dev. Agent(s) | 0.10 to 0.50 | 0.20 to 0.30 |
| Sec. Dev. Agent(s) | 0.001 to 0.04 | 0.005 to 0.01 |
| Antifoggants | 0.00001 to 0.01 | 0.0001 to 0.005 |
| Antisludge Agent(s) | 0.00 to 0.002 | 0.0001 to 0.0005 |
| Alkanol Amine(s) | 0.01 to 0.50 | 0.05 to 0.25 |
| Adjusted pH (in pH units) | 9.5 to 12.5 | 11.1 to 11.6 |
| Water | to make one liter | |

The categories of compounds listed immediately above are critical components. It is understood that water does not meet the strict definition of critical as offered above but water is a critical component in that its presence is necessary to the functioning of the developer. However, water will not be handled in the same way as other critical components as will be addressed later. There are, of course, other components which are non-critical that may be added.

NON-CRITICAL COMPONENTS

The developer may also contain a multitude of other adjuvants that are desirable, but not critical to developer performance, such as, sequestering agents, swelling control agents, anti-foaming agents and buffers. Such adjuvants are well known to those of ordinary skill in the art and this list is not to be considered as exhaustive.

Small amounts of sequestering agents (or chelating agents) are generally employed to sequester trace metal ions, e.g., copper and iron ions, present in the water or chemicals used to produce the developer and in the films. Preferred sequestering agents are sodium salts of ethylenediaminetetraacetic acid (EDTA).

Other materials that may be added to the developer, include antifreezing agents, such as ethylene glycol and polyethylene glycol. An anti-foaming agent may also be added, such as Dow 2210, a silicone emulsion made by Dow Chemical Co.

A typical and preferred fresh or working developer with both critical and non-critical components will comprise:

| Component | Preferred Range (grams) |
|---|---|
| Sodium Sulfite | 85 to 105 |
| Tridosium salt of EDTA | 3.0 to 4.0 |
| Potassium Bromide | 6.5 to 8.5 |
| Hydroquinone | 20.0 to 30.0 |
| Metol | 1.5 to 2.5 |
| Glucono-delta-lactone | 0.75 to 3.00 |
| Benzotriazole | 0.30 to 0.60 |
| Phenylmercaptotetrazole | 0.04 to 0.07 |
| 2-Mercaptobenzthiazole | 0.03 to 0.06 |
| 3-Diethylamino-1,2-propanediol | 25.0 to 55.0 |
| Adjusted pH (in pH units) | 11.1 to 11.6 |
| Water | to make one liter |

COLLECTING SPENT DEVELOPER

A process for recycling spent photographic developer in accordance with the present invention comprises the steps of determining the volume of the spent developer and reconstituting the spent developer so that it can be used in the same way that a fresh developer would be used.

Spent developer may conveniently be collected in an off-line tank when purged from a developer tank of a processor such as, during processing and/or during automatic replenishment. The spent developer is collected until a sufficient quantity is available for recycling in accordance with the present invention. It is to be understood that the process of the present invention does not require that any particular amount of spent developer be collected for recycling. It is desirable for the present invention to be practiced in batch quantities. In fact, it would be expected that in practice spent developer from many different film processors would be collected for recycling at some central location.

It is advantageous and indeed preferred that any particulate matter present in the collected spent developer be separated from the liquid. It is common for spent developer to contain a variety of foreign particulate matter, such as gelatin, conglomerates of silver, hair, dirt, paper clips, etc. The separation of liquid developer from particulate matter may be practiced in any conventional manner, such as by decanting or filtration.

RECONSTITUTION

After a convenient quantity of spent developer has been collected and its volume determined, the next step in the present process comprises reconstituting the developer for recycling. By "reconstitute", it is meant that the concentration of the critical components in the spent developer is adjusted (i.e., either increased or decreased) to obtain an aim concentration of such components so that the performance of the recycled developer would be substantially equal to performance of the original fresh developer. Reconstitution can be described as a remanufacture of the spent developer.

It should be noted that reconstitution is differentiated from such conventional processes as replenishment, in that the latter refers to the well-established practice of, for example, periodically adding quantities of fresh developer to the working developer present in a processor to make up for losses due to evaporation and/or carry-out by the film. Some of the components contained in the working developer can also be consumed through aerial oxidation and by reaction with the film being processed. In conventional replenishment, a quantity of fresh developer is added based on the amount of film processed and/or the period of time since the last replenishment addition. In practice, the quantity of fresh developer added typically must be greater than the sum of the volume of working developer carried out of the developer section of the processor plus the volume of developer lost by evaporation in order to maintain control of sensitometric and chemical parameters in the working developer in the processor. Because the volume of fresh developer added in the replenishment process exceeds the volume of working developer lost by film carryout and evaporation, the developer section of processors are typically equipped so that this excess developer flows out through an overflow tube. Ordinarily, this overflow is the spent developer that is disposed of in the sewer or through other waste disposal methods. In the present process, this overflow is collected for recycling.

While, in principle, any amount of spent developer might be collected for recycling, it is typically most advantageous to collect the spent developer from many processors and even many geographical sites. This collected developer is combined into a master batch and transformed into a recycled developer that is equal or substantially equal in performance to a fresh developer by addition of critical components and/or dilution. As will be demonstrated, the recycled developer in accordance with this invention can be used the same as a fresh developer is used, that is, either for replenishing working developer during normal processing or for initially charging a processor.

An analysis step is performed prior to, or as part of, the reconstituting step. The analysis step, as the name implies, comprises an analysis of the spent developer to determine the concentration of the various critical components which are to be increased or decreased. A determination of the pH is included as part of the analysis step. Conventional analytical methods that are used include, but are not limited to, titration, extraction, surface tension, spectroscopy and chromatography.

In particular, the spent developer is analyzed for the concentration of critical components i.e., developing agents (both primary and secondary), bromides, sulfites, alkanol amines and antifoggant(s). Primary and secondary developing agents can also be referred to as total reducing substances.

Typically, no analysis is made of non-critical components because their concentrations are assumed to remain constant.

Based on the analysis results, and depending upon the particular developer being recycled, the reconstituting step can involve the addition of certain critical components to increase the concentration thereof and/or the dilution of the spent developer to decrease the concentration. Based on conventional replenishment rates for developer, it is typically the case that the critical components are present in the spent developer in amounts from about 50% to 150% of their original starting concentrations in fresh developer. In most cases, the concentration of such components in spent developer would be lower than the original concentration in fresh developer. Those components which are lower in concentration than the original starting concentration in the fresh developer are added to the spent developer in an amount sufficient to achieve aim concentrations. However, because of evaporation of the working developer, for example, it can be possible that some critical components exhibit increased concentrations in the spent developer compared to the original starting concentrations in the fresh developer. Those components which have higher concentrations in the spent developer than original starting concentration in the fresh developer have their concentrations decreased to an aim level by diluting.

It is well known that bromide, for example, is a critical component that can be higher in concentration in spent developer than in fresh developer. With bromides, this increase is due to the use of the developer to process films which contain silver bromide grains. It may be necessary to dilute the spent developer in order to compensate for the higher concentration of the bromide or to compensate for the evaporation losses in the developer due to high temperature processing. It is important to maintain the concentration of the bromide ion due to its restraining effect; the greater the bromide concentration, the more the development of film is restrained. The concentration of the bromide in the spent developer is generally dependent upon the mix of films processed in the developer, i.e., the proportion of the processed films which are totally or partially silver bromide grain films. It should be understood that if all the films processed in the developer are entirely silver chloride grain films, for example, then the spent developer may not need to be diluted to the extent that the spent developer would if some of the films processed contained silver bromide. Another factor which can influence the concentration of bromide in the spent developer includes the amount of developed density, i.e., the proportion of the imaged film which is high density and low density.

In such instances when bromide is higher in concentration in the spent developer, the reconstituting step would involve diluting the spent developer (e.g., with water) to reduce the concentration of bromide to the aim level. Sufficient water is added to the spent developer to dilute bromide to its aim value and thereby arrive at a final volume of the reconstituted developer. Amounts of the critical components other than bromide would then be added to achieve the aim concentrations based on the final volume of reconstituted developer. For most applications, both an addition and dilution will be necessary to reconstitute the spent developer. In those circumstances, it may be convenient to combine the addition and dilution steps as may be required by formulating a special fresh developer which does not contain the particular components that need to be diluted (such as, for example, a bromide-free developer) and adding it to the spent developer to achieve the final volume of reconstituted developer. When preferred, a combination of water and special developer can be used to dilute the spent developer. There can also be instances where an excess amount of water and/or special developer is added in the diluting step and therefore it would be necessary to add bromide to increase the concentration back to aim. Adding more than the minimum amount of water and/or special developer needed to dilute the bromide just to its aim value may be done when larger quantities of developer are desired so that there is a sufficient amount on hand. Also, it may be desirable to dilute contamination products introduced into the spent developer from the film to levels lower than would be obtained by using just the minimum amount calculated for the diluting step.

The smallest volume of reconstituted developer to achieve the desired dilution is represented by $V_{min}$ which is determined in accordance with the following equation:

$$V_{min}=(V_i \times B_i)/B_a$$

where $V_{min}$=minimum volume of reconstituted developer $V_i$=volume of spent developer $B_i$=analyzed concentration of bromide in spent developer $B_a$=aim concentration of bromide in reconstituted developer.

The final volume of reconstituted developer, $V_f$, can be chosen to be equal to or greater than $V_{min}$. If $V_f=V_{min}$, there would be no need to add bromide because the dilution would have brought the bromide to the aim concentration. However, if $V_f$ is greater than $V_{min}$, the amount of bromide to add can be determined using the same process as described below for the other critical components.

To bring the volume of the spent developer from $V_i$ to $V_f$, an amount of water, $V_w$, and/or an amount of special developer, $V_s$, is added. There is considerable latitude in selecting the values for $V_s$ and $V_w$. However, $V_s$ and $V_w$ must be chosen so that the following four conditions are all met:

1. $V_w$ is greater than or equal to zero
2. $V_s$ is greater than or equal to zero
3. $V_w+V_s$ equal $V_f-V_i$
4. $V_s$ is such that considering the concentration of critical and non-critical components present in the special developer, the amount of each critical and non-critical component to be added (as calculated below) will be greater than or equal to zero.

Each of the critical components would be added in amounts as necessary to achieve the desired, concentrations in accordance with the following equation. It is assumed in this application that the additions of the critical components do not change the volume.

$$\text{Critical component to add}=(V_f\times CC_a)-(V_i\times CC_i)-(V_s\times CC_s)$$

where $CC_a$=aim concentration of critical component $CC_i$=analyzed concentration of critical component in spent developer $CC_s$=concentration of critical component in special developer.

It is also desirable to add non-critical components to the spent developer, such as, sequestering agents, swelling control agents, etc. Because the concentration of the non-critical components are assumed to remain constant in the developer, the amounts to add can be determined from the following equation:

$$\text{Amount of non-critical component to add}=\{(V_f-V_i)\times NC_a\}-(V_s\times NC_s)$$

where $NC_a$=aim concentration of non-critical component $NC_s$=concentration of non-critical component in special developer.

As noted previously, there is considerable latitude in selecting $V_w$ and/or $V_s$. One way is to select any value for $V_s$ from a minimum value of 0 to a maximum value of $V_f-V_i$. Once $V_s$ has been selected, $V_w$ is calculated as $V_w=V_f-V_i-V_s$. When this method of selecting $V_s$ is used, the composition of the special developer must be chosen such that the calculated amounts of both the critical and non-critical components to be added (as described above) are greater than or equal to zero.

More commonly, however, if a special developer is used, its composition, that is the values for each $CC_s$ and $NC_s$, is already chosen. In that case, another approach to selecting $V_s$ is used. In this approach, a series of "trial" volumes of special developer is calculated from the equations above, except that the amount of each critical and non-critical component to be added is set at zero. The equations to calculate these trial volumes for $V_s$ are:

$$V_s=\{(V_f\times CC_a)-(V_i\times CC_i)\}/CC_s \text{ for critical components, and}$$

$$V_s=\{(V_f-V_i)\times NC_a\}/NC_s \text{ for non-critical components.}$$

In general, the trial $V_s$'s calculated by the above equations would not be equal. The conditions previously set out should be satisfied, namely that:

$V_s$ must be greater than or equal to zero, and considering the concentration of critical and non-critical components present in the special developer, the amount of each critical and non-critical component to be added (as calculated from the applicable equations) will be greater than or equal to zero.

The final choice of $V_s$ should be greater than or equal to zero but also less than or equal to the smallest value of $V_s$ from the trial $V_s$'s calculated above. Any value for $V_s$ within this range can be used. After selecting $V_s$ in this manner, $V_w$ is calculated as $V_w=V_f-V_i-V_s$. The amounts of critical and non critical components to add are then calculated using the equations noted above.

One of ordinary skill in the art can choose the values for $CC_s$ and $NC_s$ so that the use of special developer provides the greatest convenience and minimizes the number of additions when reconstituting a batch of spent developer. One of ordinary skill in the art would also see that use of computers would speed the selection of $V_s$, $V_w$, $V_{min}$, and the amounts of each critical and non-critical component to be added.

It should be noted that in this invention the recycled developer typically has aim concentrations of critical components that are equal or substantially equal to the original starting concentrations of the fresh developer. However, the composition of the recycled developer will not be identical to the composition of the original fresh developer. For example, there will be substances in the recycled developer that are not found in the fresh developer. Such substances can include oxidation products resulting from the developing process as the fresh developer acts on the film as well as contamination materials originating from the film itself, such as gelatin, surfactants, dyes and the like.

Also, depending on the application or the composition of the original developer, it may be necessary to adjust the concentration of one or more critical components to an aim in the recycled developer different from the original concentration in the fresh developer. This may be necessary in order to achieve performance of the recycled developer that is substantially equal to that of the original fresh developer. While the concentrations of components in the recycled developer and the fresh developer can be equal or substantially equal, the important factor is that the performance of the recycled developer be equal or substantially equal to the performance of the fresh developer.

Photographic developers recycled according to the present invention can be used in the same manner as fresh developers, including as a replenishment solution or to initially charge the processor. They may be used in a variety of processing equipment and techniques well known to those skilled in the art.

EXAMPLES

The following examples are intended to illustrate but not to limit the claimed invention.

Example 1

The following example demonstrates one embodiment of a hydroquinone-containing recyclable developer, the recycling process, and the stability of performance through several developing cycles. A developer slurry was prepared by mixing the materials together listed in the following table.

TABLE 1

| Component | Amount | Concentration in Finished Developer |
|---|---|---|
| Water | 32 l | — |
| Trisodium salt of Ethylene-diaminetetraacetic acid (EDTA) | 230 g | 3.29 g/l |
| 39% aqueous solution of sodium hydrogen sulfite | 20 kg. | 1.07 M in sulfite |
| Hydroquinone | 1,750 g | 25 g/l |
| N-Methyl-p-aminophenol sulfate (Metol) | 175 g | 2.5 g/l |
| Potassium Bromide | 210 g | 3.0 g/l |
| 1-Phenyl-5-mercaptotetrazole (PMT) | 4.2 g | 0.06 g/l |
| Benzotriazole (BZT) | 35 g | 0.50 g/l |
| d-Gluconolactone | 70 g | 1.0 g/l |
| 2-Mercaptobenzothiazole (2-MBT) | 3.50 g | 0.05 g/l |
| N-butyldiethanolamine | 1,050 g | 15 g/l |

M = molarity
g = gram
l = liter
kg = kilogram

Ten (10) kg of a 45% aqueous solution of potassium hydroxide were added to the slurry while stirring, followed by 3,160 g of a 47% aqueous solution of potassium carbonate. After all the components had dissolved, the pH was adjusted to 10.9 with 45% aqueous potassium hydroxide solution, and the volume was adjusted to 70 liters by adding water. This fresh developer solution is referred to as R0 in the tables and discussion that follow in this example.

In addition to the R0 developer, a bromide-free special developer was made as described in the table above, except that no potassium bromide was added. The special developer is referred to as XBr in the discussion and tables that follow in this example.

A developer tank of an HT-26 processor sold by E. I. du Pont de Nemours and Company, Wilmington, Del. (hereafter DuPont) was filled with approximately 32 liters of developer R0. The remainder of the developer R0, about 48 liters, was placed in a developer replenishment tank associated with the processor. A fixer tank of the processor was filled with DLF fixer, sold by DuPont, and mixed according to label directions. The fixer tank was replenished as is conventional in the art. As is conventional in the art, a wash water tank in the processor was replenished with fresh water. The processor was run at a development temperature of 100° F. and a development time of 45 seconds (sec). As is conventional in the art, the replenishment tank contained developer for replenishing the developer in the developer tank as it was lost. The replenishment of developer was controlled in the normal fashion by setting a knob on the processor. The knob setting controlled the amount of replenishment developer pumped to the developer tank based upon the area of film processed. Periodically, the actual replenishment rate was checked. The overflow of spent developer from the developer tank that normally runs down to a drain was collected in a container. The collected spent developer was labeled X1.

When the overflow collection container holding X1 was full, it was replaced with another container, and the spent developer collected in this new container was labeled X2. The spent developer labeled X1 was reconstituted by the process described below to reconstituted developer labeled R1.

When the overflow collection container holding X2 was full, it was replaced with another container, and the spent developer collected in this new container was labeled X3. The spent developer labeled X2 was reconstituted by the process described below to reconstituted developer labeled R2.

This procedure was repeated for collection containers X3 to X6, which were reconstituted to R3 to R6, respectively.

The collection container X6 was replaced by collection container X7. When the collection container holding X7 was full, it was replaced with another container, and the spent developer collected in this new container was labeled X8.

The collected spent developers X1 through X6 were reconstituted as follows. The spent developer was weighed and filtered. Then a sample from the spent developer was analyzed for pH, total reducing substances concentrations, potassium bromide concentration, sodium sulfite concentration, and antifoggant concentration using various techniques. A pH electrode measured the pH of the collected spent developer. The concentrations of total primary and secondary developing agents, which is the sum of the total of hydroquinone, its oxidation derivatives,(i.e., hydroquinone monosulfonic acid, hydroquinone disulfonic acid), and metol, all of which are active developing agents, were measured using titration. Potassium bromide concentration was measured using a second titration. Sodium sulfite concentration was measured using a third titration. The concentration of antifoggant, 2-mercaptobenzothiazole (2-MBT), metol, benzotriazole (BZT), and 1-phenyl-5-mercaptotetrazole (PMT) were measured simultaneously in a single high performance liquid chromatographic analysis (hplc). The analytical techniques used are well known to those skilled in the art. The first titration provided the sum of the hydroquinone (and its derivatives) and metol concentrations. The hplc provided the concentration of the metol alone so that the metol can be reconstituted. The difference between the first titration and the hplc, provides the concentration of the hydroquinone and its derivatives so that they can be reconstituted.

Based on the analytical results for each batch of spent developer and the following equations, an amount of the special, bromide-free developer, XBr, was added to the spent developer to reduce the bromide level to its aim point and an amount of each of the other critical components was added as required to bring their respective concentrations to their aim points:

$$V_{min}=(V_f \times B_i)/B_a\ ,$$

where $V_{min}=V_f$;

$V_s=(V_{min}-V_i)$;

$$\text{Critical component to add}=(V_f \times CC_a)-(V_f \times CC_i)-(V_s \times CC_s).$$

The specific values for this example can be easily related to the general terms in the equations above, for example, $V_s$ is represented by XBr. Since developer XBr was used for dilution, the non-analyzed, non-critical components, such as EDTA and d-gluconolactone, were compensated for in the reconstituted developer. The resulting reconstituted developer batches, R1–R6, were re-analyzed to assure that all critical components in the reconstituted developer were at aim concentrations. The same methods were used as in the analysis step above For spent developers X1 to X8, Table 2 shows the analyses that resulted and the amounts of added components. Table 3 shows the analyses of the reconstituted developers that resulted from the additions and also the aim levels for the components.

TABLE 2

| Sample | X1 | X2 | X3 | X4 | X5 | X6 | X7 | X8 |
|---|---|---|---|---|---|---|---|---|
| Vol. (1.) | 17.7 | 19.2 | 18.0 | 19.2 | 18.7 | 10.4 | — | — |
| pH | 10.8 | 11.2 | 10.9 | 10.8 | 10.8 | 10.9 | 10.9 | 10.9 |
| Red. Sub (g HQ/1.) | 27.0 | 28.2 | 28.3 | — | 29.0 | 29.3 | 30.0 | 29.8 |
| KBr (g/1.) | 4.05 | 4.50 | 4.51 | 5.00 | 5.30 | 5.37 | 5.40 | 5.30 |
| $Na_2SO_3$ (g/1.) | 117.8 | 118.2 | 116.2 | 119.2 | 124.5 | 124.2 | 121.4 | 122.9 |
| 2-MBT (g/1.) | 0.035 | 0.037 | 0.041 | 0.039 | 0.039 | 0.038 | 0.040 | — |
| Metol (g/1.) | 2.25 | — | 2.33 | 2.81 | 2.32 | 2.31 | 2.38 | — |
| BZT (g/1.) | 0.45 | 0.47 | 0.50 | 0.49 | 0.49 | 0.49 | 0.52 | — |
| PMT (g/1.) | 0.060 | 0.049 | 0.049 | 0.048 | 0.047 | 0.045 | 0.046 | — |
| XBr added (1) | 6.2 | 9.4 | 8.8 | 10.0 | 14.5 | 8.2 | | |
| 39% $NaHSO_3$ added (ml) | 0 | 162 | 235[a] | 0 | 0 | 0 | | |
| 2-MBT added (g) | 0.27 | 0.26 | 0.18 | 0.21 | 0.21 | 0.125 | | |
| PMT added (g) | 0 | 0.22 | 0.22 | 0.23 | 0.25 | 0.156 | | |

[a]100 ml of 45% KOH solution also added to adjust pH

TABLE 3

| AFTER RECONSTITUTING | | | | | | | |
|---|---|---|---|---|---|---|---|
| Relabeled as: | R1 | R2 | R3 | R4 | R5 | R6 | Aim |
| pH | 10.9 | 10.8 | 10.9 | 10.9 | 11.0 | 11.1 | 10.9 |
| Red. Sub. (g HQ/l.) | 27.1 | 28.7 | 27.6 | 28.7 | 29.3 | 28.2 | 27.5 |
| KBr (g/l.) | 2.70 | 3.08 | 3.20 | 3.50 | 3.04 | 4.0 | 3.00 |
| $Na_2SO_3$ (g/l.) | 115.5 | 119.4 | 120.3 | 118.9 | 118.9 | 117.3 | 122 |
| 2-MBT (g/l.) | 0.052 | — | 0.050 | 0.048 | 0.051 | 0.048 | 0.05 |
| Metol (g/l.) | 2.56 | — | 2.76 | 2.30 | 2.35 | 2.33 | 2.50 |
| BZT (g/l.) | 0.47 | — | 0.484 | 0.49 | 0.50 | 0.504 | 0.50 |
| PMT (g/l.) | 0.054 | — | 0.060 | 0.057 | 0.061 | 0.058 | 0.06 |

When all of the R0 developer in the replenishment tank was used up, the replenishment tank was refilled with the reconstituted developer R1. When all the reconstituted developer R1 in the replenishment tank was used up, the replenishment tank was refilled with the reconstituted developer R2. This procedure was repeated, in turn, until the replenishment tank was last filled with reconstituted developer R6, which was then used up.

The films processed in the developer were BLF, a Bright Light Final film; QOC, Quanta One™ Camera film (negative-working); and QOS, Quanta One™ Scanner film (negative-working); all made by Dupont, Wilmington, Del. QOC and QOS are hybrid films which contain a hydrazine compound as described in U.S. Pat. Nos. 4,937,160, 5,013,844, 5,130,480, and 5,190,847. On a daily basis, large sheets of films were exposed to $D_{max}$ and processed through the processor for 45 seconds development time. 'Load Film A' condition was one 24×24 inch (in.) (61×61 cm) BLF film sheet and one 20×24 in. (51×61 cm) QOC film sheet. 'Load Film B' condition was two 24×24 in. (61×61 cm) BLF film sheets and two 20×24 in. (51×61 cm) QOC film sheets. The sensitometric performances of QOC and QOS films were monitored throughout the test period to evaluate the performance of the reconstituted developer as a replenishment solution. Both the QOC film and the QOS film were exposed on an EG&G sensitometer for $10^{-3}$ sec. through 1.5 neutral density, 44A and CL50B filters and a 4th root of 2 step wedge. Sensitometry was calculated conventionally using focal points (net densities) of 3.5 for speed, 1.0 to 3.0 for gradient, and 0.01 to 0.5 for toe gradient. Table 4 records the details of the films processed, their sensitometry values, and the replenishment conditions. Toe is reported as the number of steps between the focal points. Dmin was the minimum density and Dmax was the maximum density of the exposed and processed films. Day is a sequential count of days starting from the day of start up of the processor with fresh developer R0. Although film loads were run every day, the day number is not listed where no sensitometry measurement, replenishment setting or change in identity was made.

TABLE 4

| Load | QOC Sensitometry 45 sec @ 100° F. | | | | | | | Repl | Repl | Coll |
|---|---|---|---|---|---|---|---|---|---|---|
| Film | Speed | Grad. | $D_{min}$ | $D_{max}$ | Toe | Day | Time | Set. | ID | ID |
| A | | | | | | 1 | 8:00 A | #6 | R0 | X1 |
| A | | | | | | 1 | 10:30A | #1 | R0 | X1 |
| A | 209[A] | 18[A] | 0.04[A] | 5.80[A] | 0.72[A] | 1 | 11:00A | #1 | R0 | X1 |
| B | | | | | | 1 | 2:30P | #1[b] | R0 | X1 |
| B | 231 | 22 | 0.04 | 5.80 | 0.75 | 1 | 3:00P | #2 | R0 | X1 |
| B | 235 | 24 | 0.03 | 5.76 | 0.86 | 4 | 8:00A | #2 | R0 | X1 |
| B | 252 | 28 | 0.04 | 5.73 | 0.82 | 4 | 3:00P | #2[c] | R0 | X1 |
| B | 245 | 26 | 0.04 | 5.79 | 0.92 | 5 | 8:00A | #2 | R0 | X2 |
| B | 282 | 25 | 0.04 | 5.68 | 1.09 | 5 | 3:00P | #2 | R0 | X2 |
| B | 248 | 26 | 0.04 | 5.72 | 1.00 | 6 | 8:00A | #2 | R0 | X2 |
| B | 267 | 30 | 0.04 | 5.80 | 0.86 | 6 | 3:30P | #2 | R0 | X2 |
| B | 252 | 27 | 0.04 | 5.70 | 1.03 | 7 | 8:15A | #2 | R0 | X2 |
| B | 261 | 27 | 0.04 | 5.89 | 0.81 | 8 | 1:00P | #2 | R1 | X3 |
| B | | | | | | 11 | 2:30P | #2 | R1 | X3 |
| | | | | | | 14 | 10 A | #2 | R1 | X3 |
| B | 225 | 24 | 0.04 | 5.76 | 0.70 | 18 | 10 A | #2 | R2 | X3 |
| B | 243 | 26 | 0.04 | 5.82 | 0.56 | 18 | 3:30P | #2 | R2 | X3 |
| B | 209 | 23 | 0.04 | 5.66 | 0.85 | 19 | 7:30A | #2 | R2 | X4 |
| B | 239 | 25 | 0.03 | 5.72 | — | 19 | 3:30P | #2[d] | R2 | X4 |
| B | 219 | 21 | 0.04 | 5.67 | 0.95 | 24 | 9:30A | #2 | R2 | X4 |
| B | 235 | 24 | 0.04 | 5.73 | 1.11 | 24 | 3:30P | #2 | R2 | X4 |
| B | 227 | 22 | 0.04 | 5.77 | 0.93 | 25 | 11 A | #2 | R3 | X4 |

TABLE 4-continued

| Load | QOC Sensitometry 45 sec @ 100° F. | | | | | | | Repl | Repl | Coll |
|---|---|---|---|---|---|---|---|---|---|---|
| Film | Speed | Grad. | $D_{min}$ | $D_{max}$ | Toe | Day | Time | Set. | ID | ID |
| | | | | | | 25 | 1:00P | #2 | R3 | X4 |
| B | 228 | 21 | 0.04 | 5.62 | 1.01 | 25 | 3:00P | #2 | R3 | X5 |
| B | 224 | 21 | 0.04 | 5.60 | 1.32 | 26 | 8:30A | #2 | R3 | X5 |
| B | 223 | 21 | 0.04 | 5.67 | 1.00 | 26 | 3:00P | #2 | R3 | X5 |
| B | 212 | 20 | 0.04 | 5.64 | 1.14 | 27 | 9:00A | #2 | R3 | X5 |
| B | 238 | 23 | 0.04 | 5.66 | 1.03 | 27 | 3:30P | #3 | R3 | X5 |
| B | 239 | 23 | 0.04 | 5.53 | 1.03 | 28 | 8:00A | #3 | R3 | X5 |
| B | 247 | 25 | 0.04 | 5.73 | 1.28 | 28 | 3:00P | #3 | R4 | X6 |
| B | 231 | 22 | 0.04 | 5.69 | 1.10 | 31 | 8:00A | #3 | R4 | X6 |
| B | 248 | 25 | 0.04 | 5.76 | 1.03 | 31 | 3:00P | #3 | R4 | X6 |
| B | 257 | 22 | 0.05 | 5.75 | 1.30 | 32 | 2:30P | #3 | R4 | X6 |
| B | 229 | 22 | 0.04 | 5.66 | 1.14 | 33 | 8:30A | #3 | R4 | X6 |
| B | 256 | 24 | 0.04 | 5.84 | 1.46 | 33 | 3:00P | #3 | R4 | X6 |
| B | | | | | | 34 | 9:30A | #3 | R4 | X7 |
| B | | | | | | 34 | 12:30P | #3 | R4 | X7 |
| | | | | | | 34 | 3:00P | #3 | R5 | X7 |
| B | 239 | 23 | 0.04 | 5.69 | 1.34 | 35 | 8:30A | #3 | R5 | X7 |
| B | 256 | 24 | 0.04 | 5.72 | 1.45 | 35 | 3:30P | #3 | R5 | X7 |
| B | 242 | 24 | 0.04 | 5.70 | 1.69 | 39 | 7:30A | #3 | R5 | X8 |
| B | 268 | 24 | 0.04 | 5.73 | 1.30 | 39 | 3:00P | #3 | R5 | X8 |
| B | 260 | 22 | 0.04 | 5.71 | 1.55 | 40 | 10A | #3 | R5 | X8 |
| B | | | | | | 40 | 1:00P | #3 | R6 | X8 |
| B | | | | | | 41 | 9:00A | #3 | R6 | X9 |
| B | 254 | 25 | 0.05 | 5.80 | 1.88 | 42 | 7:30P | #3 | R6 | X9 |
| B | 287 | 25 | 0/05 | 5.77 | 1.69 | 42 | 3:30p | #3 | R6 | X9 |

A - one 24 × 24 in. (61 × 61 cm) BLF exposed to give $D_{max}$ and one 20 × 24 in. (51 × 61 cm) QOC exposed to give $D_{max}$
B - two 24 × 24 in. (61 × 61 cm) BLF exposed to give $D_{max}$ and two 20 × 24 in. (51 × 61 cm) QOC exposed to give $D_{max}$
Note:
[a]40 seconds develop time
[b]Measured replenishment rate 0.29 ml/in$^2$ (0.045 ml/cm$^2$)
[c]Measured replenishment rate 0.79 ml/in$^2$ (0.122 ml/cm$^2$)
[d]Measured replenishment rate 0.49 ml/in$^2$ (0.076 ml/cm$^2$)
[e]measured replenishment rate 0.71 ml/in$^2$ (0.110 ml/cm$^2$)

The sensitometric performance of the QOC film was consistent over the test period. The example shows that a hydroquinone-based developer containing levels of sulfite of about 1.00 molar can be recycled by reconstituting the spent developer with critical components. The example also indicates that the polymeric by-products normally generated by the development process in a hydroquinone-based developer, are minimized and do not interfere with the feasibility of recycling the spent developer. Further, the example shows that the reconstituted developer in accordance with this invention can be used as a replenishment solution multiple times after reconstitution.

Example 2

The following is an example which demonstrates an embodiment of a developer formulation, a recycling process and the stability of film sensitometry which is processed in the recycled developer. The developer was prepared by mixing the following chemicals together in a slurry:

TABLE 5

| Component | Amount | Concentration; moles/l in Finished Developer |
|---|---|---|
| Water | 32 liters | |
| Trisodium salt of EDTA | 186.5 g. | 0.009 |
| 39% aqueous solution of sodium hydrogen sulfite | 15.1 kg. | 0.94 ($NaHSO_3$) |
| Hydroquinone | 1,430 g | 0.227 |
| Metol | 85.8 g. | 0.0044 |

TABLE 5-continued

| Component | Amount | Concentration; moles/l in Finished Developer |
|---|---|---|
| Potasssium Bromide | 429.1 g. | 0.063 |
| BZT | 28.6 g. | 0.0042 |
| PMT | 3.43 g. | 0.00034 |
| d-Cluconolactone | 57.2 g. | 0.0056 |
| 2-MBT | 2.86 g. | 0.0003 |
| DEAPD | 2,175 g. | 0.258 |

7.5 kg. of a 45% aqueous solution of potassium hydroxide were added to this slurry while stirring. After complete dissolution of components of this slurry, the pH was adjusted to 11.0±0.1 with 45% aqueous potassium hydroxide solution, and the volume was adjusted to 56.8 liters by adding water. This fresh developer solution is called R2-0 in the tables and discussion of this example.

Approximately 19 liters of developer R2-0 were put in the developer tank of a 37C processor, sold by DuPont. The balance of the R2-0 was placed in the developer replenishment tank. The fixer tank and corresponding replenishment system of this processor was filled with DuCare™ DRF fixer, sold by DuPont. The processor conditions were set such that developer temperature achieved 100° F. and development time was 45 seconds. The replenishment system was set up to deliver a range of 0.2 to 0.5 ml/in$^2$ (0.031 to 0.078 ml/cm$^2$) of processed film which had been exposed to darken 50% of the area. As in the previous example, the overflow of the developer tank which normally goes to the drain was first collected in a separate container, and the collected spent developer was labeled X2-1.

When the container holding X2-1 was full, it was replaced by another container which was used to collect the next portion of spent developer, labeled X2-2. The X2-1 was analyzed and reconstituted to a portion labeled R2-1 as described below. Similarly, when the container for X2-2 was full, it was reconstituted to a portion labeled R2-2. This process was repeated with sequential spent developer portions labeled X2-3 to, X2-7, which were reconstituted to portions labeled R2-3 to R2-7, respectively.

When the replenishment tank containing R2-0 was empty, it was refilled with reconstituted developer, R2-1. Similarly, when R2-1 replenishment was consumed, it was replaced with R2-2 and so forth with sequential reconstituted developer portions. Thus, the processor was maintained in a stable working situation with succeeding reconstituted developer portions.

Spent developer, i.e. X2-1, X2-2, etc., to be reconstituted was weighed and filtered through 3 micron particle size filter pores. The developer was then analyzed. The pH was measured with a pH electrode. The developing agents, hydroquinone, hydroquinone monosulfonic acid and metol were measured using a liquid chromatographic method (previously calibrated with known amounts of each component). The potassium bromide was measured using a standardized titration method. Fog restraining agents, 1-phenyl-5-mercaptotetrazole, were measured with a liquid chromatographic method (previously calibrated with known amounts of the components).

Based on the potassium bromide analysis of the spent developer and the 7.5 g/l as the desired concentration of potassium bromide in the reconstituted developer, the final volume of reconstituted developer was determined by applying the equations used in Example 1. The volume of the reconstituted developer in this example is referred to as $V_{R2-n}$, where n refers to the particular batch of reconstituted developer. The volume of the reconstituted developer results from the addition of an amount of special bromide-free fresh developer, (called $V_{noBr}$ in this example) to the spent developer sufficient to dilute the bromide to the aim concentration. Also, based on the analytical results, and the equations from Example 1, concentrations of critical components other than bromides were determined and were added in sufficient amounts to achieve the desired aim concentrations.

Table 6 shows the amounts of spent developer collected, the analytical test results, and the aim levels for components in the reconstituted developer. The units of the test results are in g/l.

TABLE 6

| Sample: | X2-1 | X2-2 | X2-3 | X2-4 | X2-5 | X2-6 | X2-7 | Aim |
|---|---|---|---|---|---|---|---|---|
| Vol., 1. | 32.2 | 29.1 | 37.9 | 33.3 | 33.3 | 34.3 | 35.4 | |
| Dev. Agents[1]: | | | | | | | | |
| HQ | 17.38 | 15.77 | 11.85 | 10.22 | 9.00 | 6.74 | 4.54 | 25 g/l |
| HQmSO3 | 18.09 | 22.28 | 24.34 | 27.66 | 30.70 | 32.80 | 33.1 | |
| Metol | 1.50 | 1.50 | 1.56 | 1.61 | 1.54 | 1.48 | 1.30 | 1.5 g/l |
| $Na_2SO_3$ | 115.5 | 107.0 | 122.6 | 119.9 | 105.2 | 121.7 | 109.8 | 118.3 g/l |
| PMT | 0.053 | 0.053 | 0.053 | 0.053 | 0.049 | 0.046 | 0.044 | 0.06 g/l |
| 2-MBT | 0.040 | 0.030 | 0.043 | 0.042 | 0.039 | 0.033 | 0.040 | 0.05 g/l |
| pH | 11.11 | 11.10 | 11.01 | 11.07 | 10.98 | 10.93 | 10.97 | 10.9–11.1 |
| KBr | 11.94 | 9.75 | 10.67 | 11.70 | 12.60 | 12.34 | 11.86 | 7.50 g/l |
| Alkanolamine | n.d. | 37.3 | 39.5 | 47.1 | 46.4 | 44.3 | 41.3 | 40.0 g/l |
| $V_{noBr}$, 1 | 19.1 | 8.7 | 16.0 | 18.6 | 22.6 | 22.1 | 20.6 | |
| $V_{R2-n}$, 1 | 51.4 | 37.8 | 53.9 | 51.9 | 55.9 | 56.4 | 56.0 | |

[1]HQ = Hydroquinone
HQmSO3 = Hydroquinone Monosulfonic Acid

In a processing test, a mix of films was used including Contacting films (BLD and BLF), Imagesetting films (CHC and CFR) and films having high contrast known as Hybrid films (Quanta-One™ Camera, QOC and Quanta-One™Scanner, QOS). The developer which is represented in this example should be useful for all films used concurrently, but the most sensitive to developer changes is the Hybrid film QOC. The following Table 7 lists the details of sensitometry for the QOC film that was processed and the replenishment conditions when 60 to 100 square feet (5.58 to 9.3 $m^2$) of film (50% exposed) were processed daily:

TABLE 7

| | | | | | Hybrid camera film sensi. | | | | |
|---|---|---|---|---|---|---|---|---|---|
| Date | Time | Repl. Rate* | Repl. ID | Coll. ID | Dens. min. | Dens. max. | spd. | grad. | toe |
| 2/16 | 8:15A | 0.32 | R2-0 | X2-1 | 0.03 | 5.46 | 154 | 19.6 | 0.78 |
| 2/17 | 11:30 | 0.32 | R2-0 | X2-1 | 0.03 | 5.53 | 142 | 15.2 | 1.24 |
| 2/18 | 2:45P | 0.32 | R2-0 | X2-1 | 0.03 | 5.47 | 142 | 19.3 | 1.54 |
| 2/22 | 3:00P | 0.38 | R2-0 | X2-1 | 0.03 | 5.53 | 146 | 16.6 | 1.22 |
| 2/23 | 3:00P | 0.41 | R2-0 | X2-1 | 0.03 | 5.42 | 132 | 14.0 | 1.23 |
| 2/24 | 3:35P | 0.38 | R2-0 | X2-1 | 0.03 | 5.30 | 131 | 15.5 | 1.03 |
| 2/25 | 1:45P | 0.38 | R2-0 | X2-2 | 0.03 | 5.40 | 131 | 16.6 | 1.51 |
| 2/28 | 12:35 | 0.38 | R2-0 | X2-2 | 0.03 | 5.24 | 136 | 16.4 | 1.39 |
| 2/28 | 2:00P | 0.37 | R2-1 | X2-2 | 0.03 | 5.29 | 139 | 16.2 | 1.25 |
| 3/1 | 3:00P | 0.36 | R2-1 | X2-2 | 0.03 | 5.02 | 134 | 15.4 | 1.41 |
| 3/2 | 4:00P | 0.42 | R2-1 | X2-2 | 0.03 | 5.05 | 136 | 15.8 | 1.45 |
| 3/3 | 2:45P | 0.38 | R2-1 | X2-2 | 0.03 | 5.20 | 156 | 17.4 | 1.66 |
| 3/4 | 12:45 | 0.38 | R2-1 | X2-2 | 0.03 | 5.18 | 130 | 16.2 | 0.91 |
| 3/7 | 1:50P | 0.38 | R2-1 | X2-2 | 0.03 | 5.13 | 129 | 15.4 | 1.29 |
| 3/8 | 3:50P | 0.39 | R2-1 | X2-2 | n.d. | n.d. | n.d. | n.d. | n.d. |
| 3/9 | 3:45P | 0.37 | R2-1 | X2-3 | n.d. | n.d. | n.d. | n.d. | n.d. |
| 3/10 | 4:15P | 0.38 | R2-1 | X2-3 | n.d. | n.d. | n.d. | n.d. | n.d. |
| 3/11 | 3:30P | 0.30 | R2-2 | X2-3 | 0.02 | 5.16 | 139 | 18.9 | 2.00 |
| 3/14 | 4:00P | 0.34 | R2-2 | X2-3 | 0.03 | 5.27 | 134 | 15.6 | 1.38 |
| 3/15 | 11:00 | 0.68 | R2-2 | X2-4 | 0.03 | 5.10 | 140 | 14.5 | 1.37 |
| 3/16 | 1:30P | 0.39 | R2-2 | X2-4 | 0.02[1] | 5.25[1] | 174[1] | 16.0[1] | 1.66[1] |
| 3/17 | 4:15P | 0.34 | R2-2 | X2-4 | 0.03 | 5.48 | 168 | 15.9 | 1.06 |
| 3/18 | 2:45P | 0.33 | R2-3 | X2-4 | 0.03 | 5.27 | 175 | 17.3 | 1.11 |
| 3/21 | 3:30P | 0.35 | R2-3 | X2-4 | 0.03 | 5.19 | 156 | 16.1 | 1.16 |
| 3/22 | 3:35P | 0.35 | R2-3 | X2-4 | 0.03 | 5.33 | 171 | 16.7 | 1.61 |
| 3/23 | 3:25P | 0.35 | R2-3 | X2-4 | 0.03 | 5.28 | 181 | 18.4 | 2.03 |
| 3/24 | 10:05 | 0.35 | R2-3 | X2-5 | 0.03 | 5.21 | 189 | 17.5 | 0.98 |
| 3/25 | 11:00 | 0.35 | R2-3 | X2-5 | 0.02 | 5.35 | 191 | 17.3 | 1.59 |
| 3/28 | 3:30P | 0.35 | R2-4 | X2-5 | 0.03 | 5.22 | 165 | 16.8 | 1.66 |
| 3/29 | 12:30A | 0.35 | R2-4 | X2-5 | 0.02 | 5.29 | 170 | 16.4 | 1.74 |
| 3/30 | 12:35 | 0.35 | R2-4 | X2-5 | 0.02 | 5.25 | 183 | 15.1 | 1.37 |
| 3/31 | 4:00P | 0.35 | R2-4 | X2-5 | 0.03 | 5.23 | 185 | 14.0 | 1.12 |
| 4/4 | 3:45P | 0.35 | R2-4 | X2-5 | 0.03 | 5.21 | 137 | 12.2 | 1.18 |
| 4/5 | 3:15P | 0.35 | R2-4 | X2-5 | 0.03 | 5.21 | 145 | 14.8 | 1.38 |
| 4/6 | 12:15 | 0.35 | R2-4 | X2-6 | 0.03 | 5.31 | 168 | 15.9 | 1.51 |
| 4/7 | 8:30P | 0.35 | R2-4 | X2-6 | 0.02 | 5.13 | 161 | 13.4 | 1.19 |

TABLE 7-continued

| Date | Time | Repl. Rate* | Repl. ID | Coll. ID | Hybrid camera film sensi. Dens. min. | Dens. max. | spd. | grad. | toe |
|---|---|---|---|---|---|---|---|---|---|
| 4/8 | 8:00A | 0.35 | R2-4 | X2-6 | n.d. | n.d. | n.d. | n.d. | n.d. |
| 4/14 | 3:15P | 0.35 | R2-5 | X2-6 | 0.03 | 5.09 | 197 | 19.6 | 1.25 |
| 4/15 | 12:15 | 0.35 | R2-5 | X2-6 | 0.02 | 5.09 | 174 | 22.9 | 1.52 |
| 4/18 | 8:45A | 0.35 | R2-5 | X2-6 | 0.03 | 5.24 | 171 | 16.8 | 1.49 |
| 4/19 | 3:25P | 0.35 | R2-5 | X2-6 | 0.03 | 5.14 | 167 | 16.6 | 1.61 |
| 4/20 | 3:30P | 0.35 | R2-5 | X2-6 | 0.03 | 5.12 | 180 | 17.1 | 1.78 |
| 4/21 | 12:05 | 0.35 | R2-5 | X2-6 | 0.02 | 5.17 | 159 | 14.5 | 2.03 |
| 4/22 | 8:00A | 0.35 | R2-5 | X2-6 | 0.02 | 4.92 | 138 | 17.5 | 1.91 |
| 4/25 | 8:15A | 0.35 | R2-5 | X2-6 | 0.02 | 5.18 | 156 | 14.8 | 1.79 |
| 4/26 | 8:00P | 0.35 | R2-5 | X2-6 | 0.02 | 5.14 | 135 | 13.7 | 1.79 |
| 4/27 | 3:25P | 0.35 | R2-5 | X2-6 | 0.02 | 5.17 | 164 | 15.0 | 1.50 |
| 4/28 | 3:30P | 0.35 | R2-5 | X2-6 | 0.02 | 5.27 | 176 | 14.1 | 1.22 |
| 4/29 | 12:10 | 0.35 | R2-5 | X2-7 | 0.02 | 5.04 | 157 | 13.6 | 1.27 |
| 5/2 | 3:25P | 0.32 | R2-5 | X2-7 | 0.02 | 5.03 | 162 | 13.8 | 1.21 |
| 5/3 | 12:05 | 0.33 | R2-5 | X2-7 | 0.03 | 5.13 | 143 | 13.0 | 1.79 |
| 5/4 | 12:10 | 0.47 | R2-6 | X2-7 | 0.03 | 5.02 | 141 | 14.3 | 1.44 |
| 5/6 | 8:00A | 0.36 | R2-6 | X2-7 | 0.02 | 5.12 | 143 | 15.4 | 1.47 |
| 5/9 | 3:15P | 0.37 | R2-6 | X2-8 | 0.03 | 5.12 | 149 | 13.7 | 1.83 |
| 5/11 | 3:20P | 0.40 | R2-6 | X2-8 | 0.03 | 5.14 | 128 | 15.2 | 2.00 |
| 5/16 | 12:00 | 0.37 | R2-7 | X2-8 | 0.03 | 5.08 | 154 | 19.4 | 1.37 |
| 5/19 | 8:30A | 0.41 | R2-7 | X2-8 | 0.03 | 5.08 | 188 | 22.1 | 1.57 |
| 5/20 | 8:00A | 0.41 | R2-7 | X2-9 | 0.02 | 5.02 | 158 | 19.3 | 1.39 |

*Replenishment Rate in ml per square inch (1 m;/in$^2$ equals 0.155 ml/cm$^2$) of processed film at 50% exposure.
n.d. = not determined
[1]Film roll changed.

As was the case in Example 1, the sensitometric performance of the QOC film was consistent over the test period.

Example 3

The following example demonstrates a conventional hydroquinone developer formulation which would not be well suited for a recycling process. The developer was prepared by mixing the following chemicals together in a slurry:

TABLE 8

| Component | Amount | Concentration; moles/1 in Finished Developer |
|---|---|---|
| Water | 32 liters | |
| Trisodium salt of EDTA | 209.8 g. | 0.009 |
| 39% aqueous solution of sodium hydrogen sulfite | 9.17 kg. | 0.57 ($NaHSO_3$) |
| Hydroquinone | 1,430 g | 0.227 |
| Metol | 85.8 g. | 0.0044 |
| Potasssium Bromide | 170.3 g. | 0.025 |
| BZT | 28.6 g. | 0.0042 |
| PMT | 3.43 g. | 0.00034 |
| d-Gluconolactone | 57.2 g. | 0.0056 |
| DEAPD | 1,419 g. | 0.170 |
| 45% aqueous solution of potassium hydroxide | 5.1 kg. | 0.726 (KOH) |
| 47% aqueous solution of Potassium Carbonate | 4.6 kg. | 0.277 ($K_2CO_3$) |

After complete dissolution of components of this slurry, the pH was adjusted to 11.0±0.1 with 45% aqueous potassium hydroxide solution, and the volume adjusted to 56.8 liters by adding water. This fresh developer solution is called R3-0 in the tables and discussion of this Example.

Approximately 19 liters of developer R3-0 were put in the developer tank of a DuPont 37C processor. The balance of the R3-0 was placed in the developer replenishment tank. The fixer tank and corresponding replenishment system of this processor was filled with DuPont's DuCare™ DRF fixer. The processor conditions were set such that developer temperature achieved 100° F. and development time 35 seconds. The replenishment system was set up to deliver a range of 0.2 to 0.5 ml/in$^2$ (0.031 to 0.078 ml/cm$^2$) of processed film which had been exposed to darken 50% of the area. The overflow of the developer tank which normally goes to the drain was directed to a separate container, and the collected spent developer was labeled X3-1.

When the container holding X3-1 was full, it was replaced by another container which was used to collect the next portion of spent developer, labeled X3-2. The X3-1 was analyzed and reconstituted to a portion labeled R3-1 as described below. Similarly, when the container for X3-2 was full, it was reconstituted to a portion labeled R3-2 and so forth with sequential spent developer portions.

When the replenishment tank containing R3-0 was empty, it was refilled with reconstituted developer, R3-1. Similarly, when R3-1 replenishment was consumed, it was replaced with R3-2 and so forth with sequential reconstituted developer portions. Thus, the processor was maintained in a stable working situation with succeeding reconstituted developer portions.

Spent developer portions, i.e. X3-1, X3-2, etc., to be reconstituted were weighed and filtered through 3 micron particle size filter pores. The developer was then analyzed as described in Example 2. Based on potassium bromide analysis of the spent developer, the final volume of reconstituted developer was determined by the same equations and procedures as in Example 2. However, the aim concentration of potassium bromide in the reconstituted developers of this Example was 3.0 g/l.

It is known that the concentration of the spent developer increases when films containing bromide are processed. As such, the volume of the reconstituted developer results from the addition of an amount of special bromide-free fresh developer, $V_{noBr}$, to the spent developer sufficient to dilute the bromide to the desired concentration. Also, based on the analytical results, concentrations of critical components other than bromide were determined and were added in sufficient amounts to achieve the aim concentrations.

Table 9 shows the amounts of spent developer collected, the analytical test results, the final volume of reconstituted developer and the aim levels for the components to be added. The units for the test results are in g/l.

TABLE 9

| Sample: | X3-1 | X3-2 | X-3 | X3-4 | Aim |
|---|---|---|---|---|---|
| Vol., 1. | 26.25 | 30.30 | 32.83 | 37.54 | |
| Dev. Agents: | | | | | |
| HQ | 13.19 | 14.75 | 13.42 | 6.81 | 25.0 g/l |
| HQmSO3 | 10.37 | 17.48 | 18.17 | 23.40 | |
| Metol | 1.33 | 1.23 | 1.36 | 1.32 | 1.5 g/l |
| $NA_2SO_3$ | 69.3 | 71.9 | n.d. | 82.5 | 71.8 g/l |
| PMT | 0.035 | 0.033 | 0.040 | 0.039 | 0.05 g/l |
| pH | 11.05 | 11.09 | 10.95 | 11.00 | 10.9–11.1 |
| KBr | 3.65 | 4.42 | 4.02 | 3.83 | 3.00 g/l |
| Alkanolamine | 20.2 | 23.2 | 24.2 | 21.0 | 25.0 g/l |
| $V_{noBr}$, 1 | 6.65 | 15.8 | 23.95 | 11.96 | |
| $V_{R3-n}$, 1 | 32.9 | 46.1 | 56.8 | 49.5 | |

n.d. = not determined

In a processing test, a mix of films was used including DuPont's Contacting films (BLD and BLF), Imagesetting films (CHC and CFR) and high contrast Hybrid films (Quanta-One™ Camera, QOC, and Quanta-One™ Scanner, QOS). The developer which is represented in this example should be useful for all films used concurrently, but the film most sensitive to developer changes is Hybrid film QOC. Table 10 shows the details of sensitometry for the QOC hybrid film processed and replenishment conditions when between 60 to 100 sq. ft. (5.58 to 9.3 $m^2$) film (50% exposed) was processed daily.

TABLE 10

| | | Repl. | Repl. | Coll. | Hybrid camera film sensitometry | | | | |
|---|---|---|---|---|---|---|---|---|---|
| Date | Time | Rate* | ID | ID | Dmin. | Dmax. | spd. | grad. | toe |
| 6/9 | 12:15P | 0.46 | R3-0 | X3-1 | 0.04 | 5.55 | 152 | 20.3 | 1.64 |
| 6/10 | 3:30P | 0.37 | R3-0 | X3-1 | 0.04 | 5.57 | 164 | 19.3 | 2.24 |
| 6/13 | 3:30P | 0.41 | R3-0 | X3-1 | 0.04 | 5.56 | 160 | 19.1 | 1.31 |
| 6/14 | 3:35P | 0.38 | R3-0 | X3-1 | 0.03 | 5.25 | 116 | 20.8 | 2.13 |
| 6/15 | 12:25P | 0.50 | R3-0 | X3-1 | 0.04 | 5.32 | 155 | 18.2 | 1.23 |
| 6/16 | 9:35A | 0.44 | R3-0 | X3-2 | 0.04 | 5.19 | 159 | 10.8 | 1.79 |
| 6/17 | 9:00A | 0.56 | R3-0 | X3-2 | 0.04 | 5.39 | 159 | 19.1 | 2.40 |
| 6/20 | 9:30A | 0.46 | R3-0 | X3-2 | 0.04 | 5.13 | 164 | 19.3 | 2.12 |
| 6/21 | 3:00P | 0.35 | R3-1 | X3-2 | 0.04 | 5.42 | 163 | 19.2 | 1.23 |
| 6/22 | 12:15P | 0.40 | R3-1 | X3-2 | 0.04 | 5.73 | 166 | 19.2 | 1.34 |
| 6/23 | 8:50P | 0.40 | R3-1 | X3-2 | 0.04 | 5.36 | 176 | 22.0 | 1.23 |
| 6/29 | 8:50A | 0.82 | R3-2 | X3-3 | 0.04 | 5.89 | 198 | 29.1 | 2.08 |
| 6/30 | 12:45P | 0.23 | R3-2 | X3-3 | 0.04 | 5.62 | 193 | 26.3 | 2.09 |
| 7/1 | 12:15P | 0.28 | R2-2 | X3-3 | 0.04 | 5.92 | 204 | 32.3 | 1.36 |
| 7/5 | 3:30P | 0.36 | R3-2 | X3-3 | 0.04 | 5.31 | 210 | 32.7 | 1.48 |
| 7/6 | 12:00P | 0.26 | R3-2 | X3-3 | 0.04 | 5.70 | 196 | 26.6 | 1.68 |
| 7/12 | 3:30P | 0.37 | R3-3 | X3-4 | 0.04 | 4.86 | 110 | 14.3 | 1.31 |
| 7/13 | 12:30P | 0.35 | R3-3 | X3-4 | 0.04 | 4.64 | 96 | 13.7 | 1.29 |
| 7/14 | 12:15P | 0.35 | R3-3 | X3-4 | 0.04 | 4.53 | 41 | 5.4 | 1.09 |
| 7/15 | 3:30P | 0.44 | R3-3 | X3-4 | 0.04 | 4.39 | 41 | 3.6 | 1.21 |
| 7/18 | 11:30A | 0.37 | R3-3 | X3-4 | 0.04 | 4.29 | 30 | 3.1 | 1.26 |
| 7/27 | 12:05P | 0.38 | R3-4 | X3-5 | 0.04 | 4.09 | 25 | 2.4 | 1.52 |

*Replenishment Rate in ml per square inch of processed film at 50% exposure.

Unlike the results in Examples 1 and 2 above, the sensitometric data for this conventional developer was not consistent over the period tested. The QOC film demonstrated a marked drop-off in Dmax, speed and gradient during the test period. This drop-off can be observed at around the 7/12 date. This drop-off is indicative that a conventional hydroquinone developer is not a good candidate for recycling.

What is claimed is:

1. A process for recycling a spent developer for use in black-and-white silver halide photographic processing comprising the steps of:

a) determining a volume, $V_i$, of the spent developer resulting from use of a fresh developer wherein the fresh developer comprises (1) a developing agent selected from the group consisting of hydroxybenzene compounds, derivatives of hydroxybenzene compounds, and mixtures thereof, and (2) a compound which provides a sulfite concentration of 0.65 to 1.5 molar;

b) analyzing the spent developer to determine the pH and the concentration of critical components which are primary developing agents, secondary developing agents, bromides, antifoggants, sulfites, and alkanol amines;

c) reconstituting the spent developer for re-use, based on results of a) and b), comprising:

(1) determining a final volume, $V_f$, of reconstituted developer based on the relationship:

$$V_{min}=(V_i \times B_i)/B_a$$

where $V_{min}$=minimum volume of reconstituted developer and $V_f$ is greater than or equal to $V_{min}$ $B_a$=aim concentration of bromide in the reconstituted developer $B_i$=analyzed concentration of bromide in the spent developer, (2) determining a volume of water, $V_w$, greater than or equal to zero, and a volume of special fresh developer, $V_s$, greater than or equal to zero, such that $V_w+V_s=V_f-V_i$ (3) diluting the spent developer with the volume of water, $V_w$, and/or the volume of special fresh developer, $V_s$, (4) adding amounts of the critical components to the spent developer in sufficient quantity to achieve aim concentrations as determined from the equation, $$\text{Amount of critical component to add}=(V_f \times CC_a)-(V_i \times CC_i)-(V_s \times CC_s)$$

where $CC_a$=aim concentration of critical component $CC_i$=analyzed concentration of critical component in spent developer $CC_s$=concentration of critical component in special fresh developer with the proviso that the total amount of critical component added is greater than or equal to zero, (5) adding amounts of non-critical components to the spent developer as determined from the equation, $$\text{Amount of non-critical component to add}=\{(V_f-V_i) \times NC_a\}-(V_s \times NC_s)$$

where $NC_a$=aim concentration of non-critical component $NC_s$=concentration of non-critical component in special fresh developer with the proviso that the total amount of non-critical component added is greater than or equal to zero, and wherein steps c)(3), c)(4), and c)(5) can be performed in any order.

2. The process of claim 1, wherein the fresh developer comprises sulfite in a concentration between 0.65 and 1.25M.

3. The process of claim 1, wherein the fresh developer comprises sulfite in a concentration between 0.7 and 0.9M.

4. The process of claim 1, further comprising the step of filtering the spent developer to remove particulate matter before reconstituting.

5. The process of claim 1, wherein the reconstituting step further comprises analyzing the reconstituted developer after steps c)(1) through c)(5) have been performed.

6. The process of claim 1, wherein the reconstituting step further comprises adjusting the pH to the range 9.5 to 12.5.

7. The process of claim 1, wherein $V_s$ equals zero.

8. The process of claim 1, wherein $V_w$ equals zero.

9. The process of claim 1 wherein the steps c)(1), c)(2), c)(3), c)(4) and c)(5) are performed in sequential order.

10. The process of claim 1 or 9 wherein step (a) is for recycling a spent developer for use in determining a volume, Vi, of the spent developer resulting from use of a recycled developer wherein the recycled developer comprises (1) a developing agent selected from the group consisting of hydroxybenzene compounds, derivatives of hydroxybenzene compounds, and mixtures thereof, and (2) a compound which provides a sulfite concentration of 0.65 to 1.5 molar.

* * * * *